US005806143A

United States Patent [19]

Tsai

[11] Patent Number: 5,806,143

[45] Date of Patent: Sep. 15, 1998

[54] THREE-SEGMENTED EXPANDABLE PULL ROD OF LUGGAGE

[76] Inventor: James Tsai, 103, Ta-Min 1 Rd., Tung Pao Tsun, Tan Tzu Hsiang, Taichung Hsien, Taiwan

[21] Appl. No.: 898,572

[22] Filed: Jul. 22, 1997

[51] Int. Cl.[6] ..... A47B 95/02

[52] U.S. Cl. ..... 16/115; 280/655.1; 280/47.315; 280/655

[58] Field of Search ..... 16/115; 280/655, 280/655.1, 47.31, 47.315; 190/39, 115, 18 A

[56] References Cited

U.S. PATENT DOCUMENTS 5,692,266 12/1997 Tsai ..... 16/115
5,704,725 1/1998 Horing ..... 16/115

*Primary Examiner*—Chuck Mah
*Attorney, Agent, or Firm*—Browdy and Neimark

[57] ABSTRACT

A three-segmented expandable pull rod for luggage is composed of a handle, two first segments fastened with both ends of the handle, two second segments for receiving extractably and retractably the first segments, two third segments for receiving extractably and retractably the second segments, and two locating sets each having a control member, a main elastic element, a first retaining member and a second retaining member. The second segment is retracted into the third segment such that the bottom end of the second segment presses against the control member so as to cause the second retaining member to retract, thereby causing the first retaining member to engage the first retaining hole of the third segment. The second segment is extracted from the third segment such that the control member is urged by the main elastic element so as to force the first retaining member to retract, thereby causing the second retaining member to engage the second retaining hole of the third segment.

8 Claims, 4 Drawing Sheets

THREE-SEGMENTED EXPANDABLE PULL ROD OF LUGGAGE

FIELD OF THE INVENTION

The present invention relates generally to a luggage accessory, and more particularly to an expandable three-segmented pull rod of the luggage.

BACKGROUND OF THE INVENTION

There are a variety of expandable two-segmented pull rods that are used as accessories of luggages or luggage carriers, such as the expandable pull rod disclosed in the U.S. patent application Ser. No. 08/680,548. As shown in FIG. 30 of the pending U.S. Pat. Application referred to above, a connection rod 24 is triggered by the push button to actuate a retaining member 18, which is located at the bottom of the first segment 12, to engage in a retaining action or a releasing action so as to locate the bottom end of the first segment 12 at a predetermined position of the second segment 10, thereby enabling the first and the second segments to remain in a retractable or extractable state. Upon being extracted, the pull rod has a total length which is limited by the length of one tubular member. An effort made to increase the length of the tubular member is not feasible in view of the fact that the overall size of the luggage must be in conformity with the luggage regulations of the air carrier industry. The conversion of the two-segmented pull rod into a three-segmented pull rod is by no means a panacea to the problems described above, in view of the fact that the connection rod 24 is incapable of actuating a second retaining member which is located at the bottom of the second segment 10 to engage in the retaining action of the second and the third segments.

SUMMARY OF THE INVENTION

The primary objective of the present invention is therefore to provide a luggage with a three-segmented pull rod capable of effective retraction and extraction.

In keeping with the principle of the present invention, the foregoing objective of the present invention is attained by a three-segmented expandable pull rod, which is composed of a handle, two first segments connected with two ends of the handle, two second segments for receiving the first segments, two third segments each having a first retaining hole and a second retaining hole, and two locating sets each having a control member, an main spring urging the control member, a first retaining member engageable with the first retaining hole, and a second retaining member engageable with the second retaining hole. The control member has an inclined surface, whereas the first and the second retaining members have an inclined surface capable of being forced to move horizontally when the control member displaces longitudinally. The control member is urged downwards when the first segment is retracted into the second segment.

The foregoing objective, features and functions of the present invention will be more readily understood upon a thoughtful deliberation of the following detailed description of an embodiment of the present invention with reference to the accompanying drawings.

DETAILED DESCRIPTION OF THE INVENTION

Figure 1:
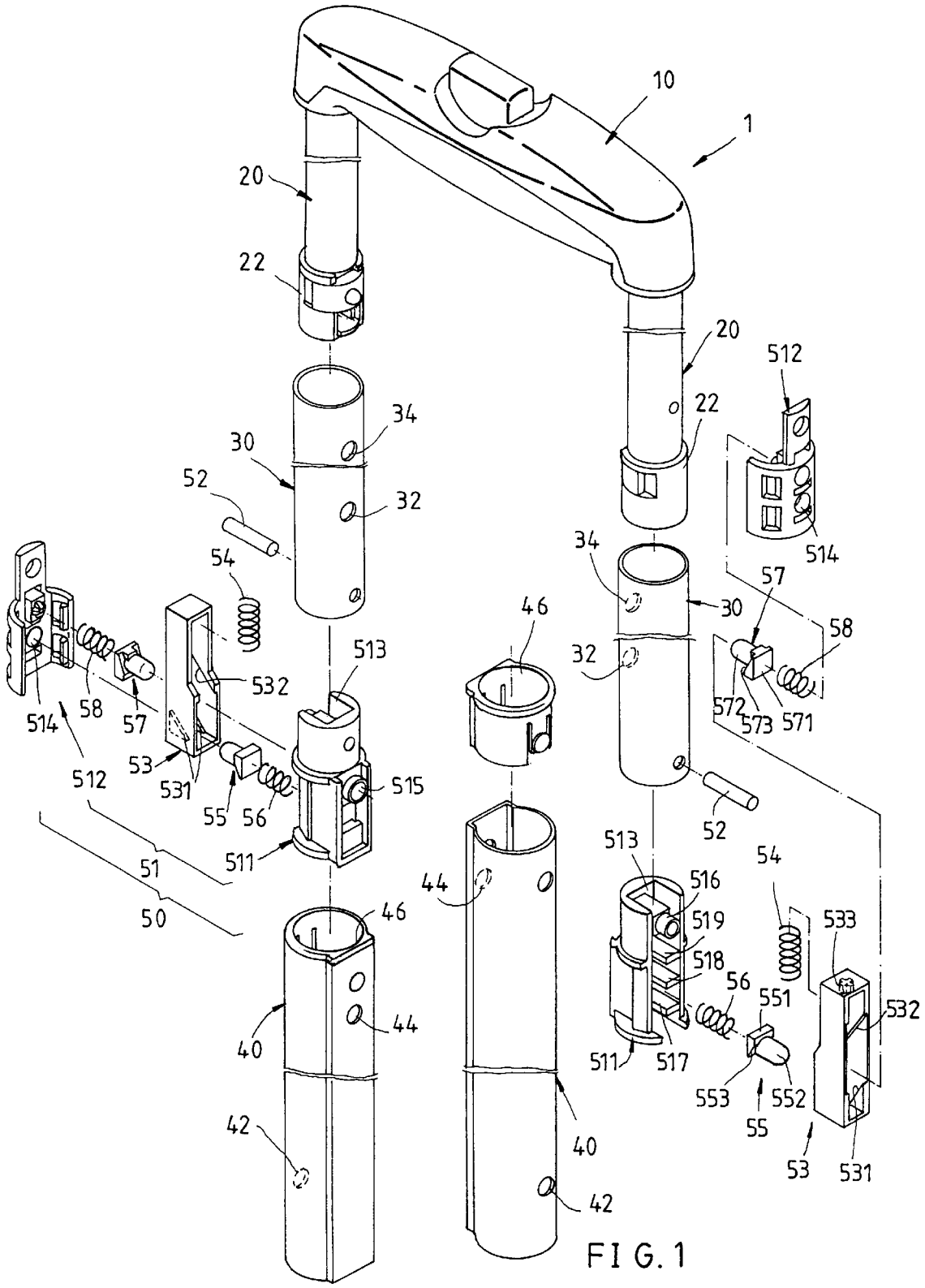
FIG. 1 shows an exploded view of the present invention.
Figure 2:
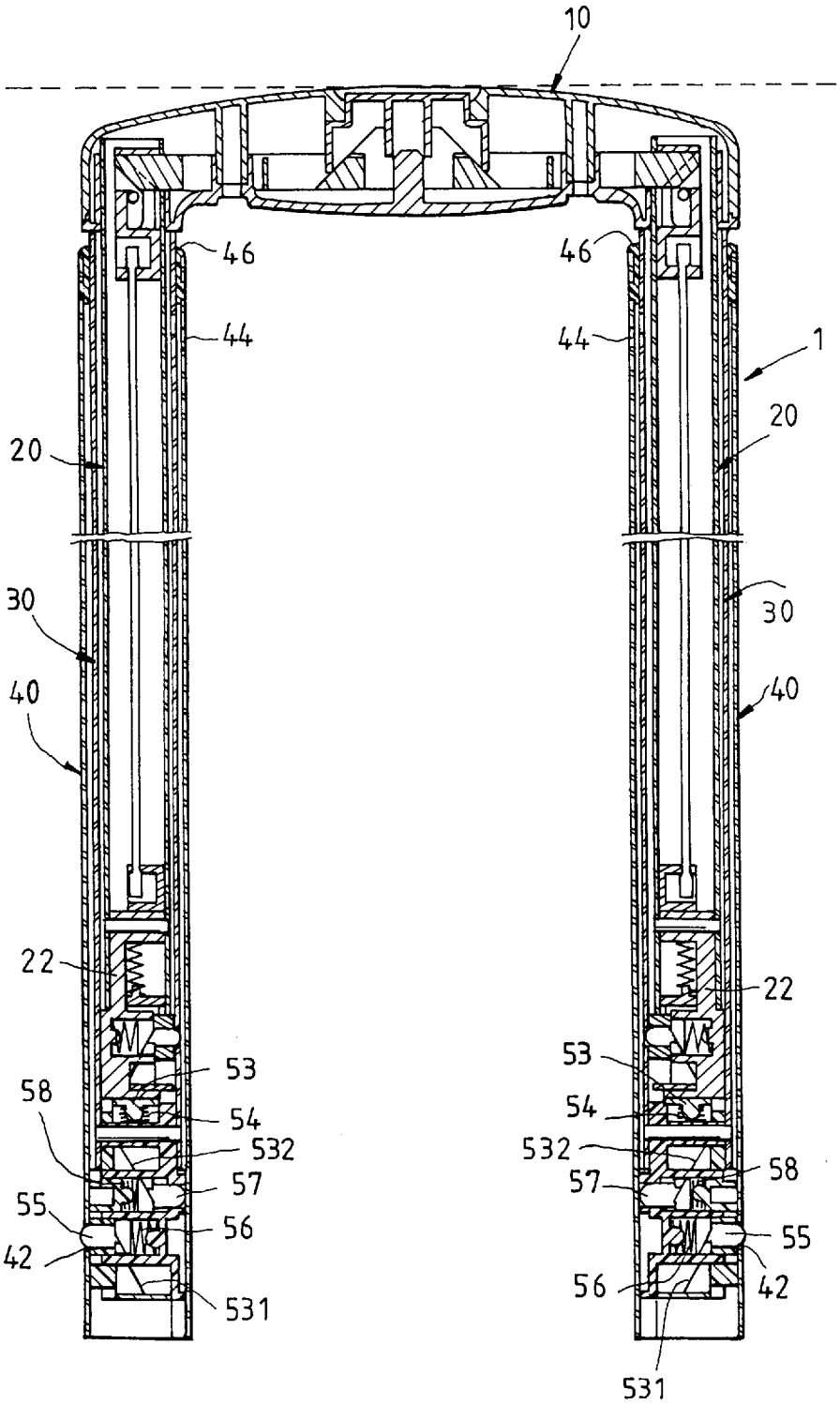
FIG. 2 shows a sectional view of the present invention in the retraction state.

As shown in FIGS. 1 and 2, a luggage pull rod 1 embodied in the present invention is composed of a handle 10, two first segments 20, two second segments 30, two third segments 40, and two locating sets 50.

Please refer to the U.S. Ser. No. 08/680,548 for details of the handle 10, the two first segments 20 and the two second segments 30.

The two third segments 40 are arranged side by side in a parallel manner and are provided respectively in the outer side near the bottom end thereof with a first retaining hole 42, and in the inner side near the top end thereof with a second retaining hole 44. The third segments 40 are further provided respectively at the top end thereof with a top end member 46 fitted thereinto. The second segments 30 are received in the third segments 40. The second segments 30 have an outer diameter which is about equal to the inner diameter of the top end member 46. The second segments 30 can be extracted from the top ends of the third segments 40.

The locating sets 50 have a casing 51 which is formed of an inner casing member 511 and an outer casing member 512. The top end of the casing 51 is inserted into the bottom end of each of the second segments 30 and fastened by a pin. The casing 51 is provided at the top thereof with a top hole 513 in the outer side thereof with a first side hole 514, and in the inner side thereof with a second side hole 515. A control member 53 of a plate frame construction is engaged with a fitting pillar 516 located in the casing 51, and three cross partitions 517, 518 and 519 which are also located in the casing 51. The control member 53 is capable of a limited longitudinal displacement in the casing 51. The control member 53 is provided respectively in two inner walls thereof with a first inclined surface 531 facing upwards and inwards, and a second inclined surface 532 facing downwards and outwards. A main elastic element 54, which is a coil spring, has a top end which is fitted over a fastening portion 533 located at the bottom side of the top of the control member 53. The main elastic element 54 further has a bottom end which urges the top of the fitting pillar 516 so as to urge the control member 53 upwards. A first retaining member 55 is disposed between two cross partitions 517 and 518 of the casing 51 such that the first retaining member 55 is capable of a horizontal displacement. The first retaining member 55 has an end plate 551 which is provided with a projection 552 extending from the end plate 551 such that the projection 552 faces the first side hole 514. The end plate 551 is further provided with two inclined portions 553 facing downwards and outwards such that the inclined portions 553 are in an intimate contact with the first inclined surfaces 531 of the control member 53. A first elastic element 56, which is a coil spring, is disposed between the first retaining member 55 and the inner casing member 511 such that the first retaining member 55 is urged by the first elastic element 56 in the direction toward the first side hole 514. A second retaining member 57 is disposed between two cross partitions 518 and 519 of the casing 51 such that the second retaining member 57 is capable of a horizontal displacement. The second retaining member 57 is similar in shape to the first retaining member 55. However, the first retaining and the second retaining members 55 and 57 are opposite to each other in the directions in which they are disposed. As a result, the projection 572 of the second retaining member 57 faces the second side hole 515. In the meantime, the two inclined portions 553 of the end plate 551 are in an intimate contact with the two second inclined surfaces 532 of the control member 53. A second elastic element 58, which is a coil spring, is located between the second retaining member 57 and the outer casing member 512 such that the second elastic element 58 urges the second retaining member 55 in the direction toward the second side hole 515.

As illustrated in FIG. 2, when the three-segmented pull rod 1 of the present invention is in the retraction state, the top of the control member 53 of the locating set 50 is obstructed by the bottom of a retaining member 22, which is a prior art structure. As a result, the control member 53 remains at a low level within a displacement range. In the meantime, the projection 552 of the first retaining member 55 is engaged with the first retaining hole 42 of the third segment 40 via the first side hole 514, whereas the second retaining member 57 is forced by the second inclined surfaces 532 to retract into the casing 51 of the locating set 50.

Figure 3:
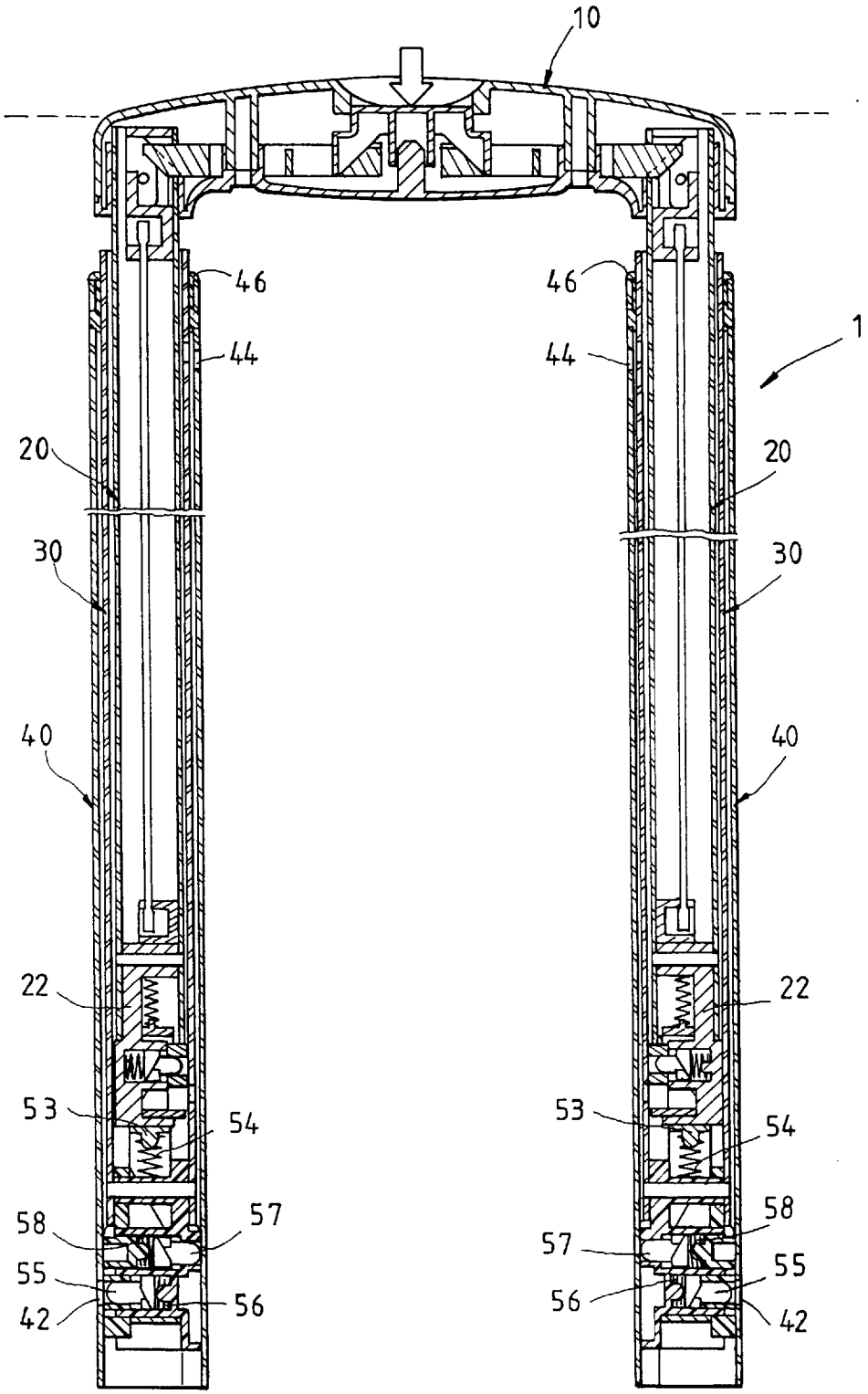
FIG. 3 shows a schematic view of the present invention at work.
Figure 4:
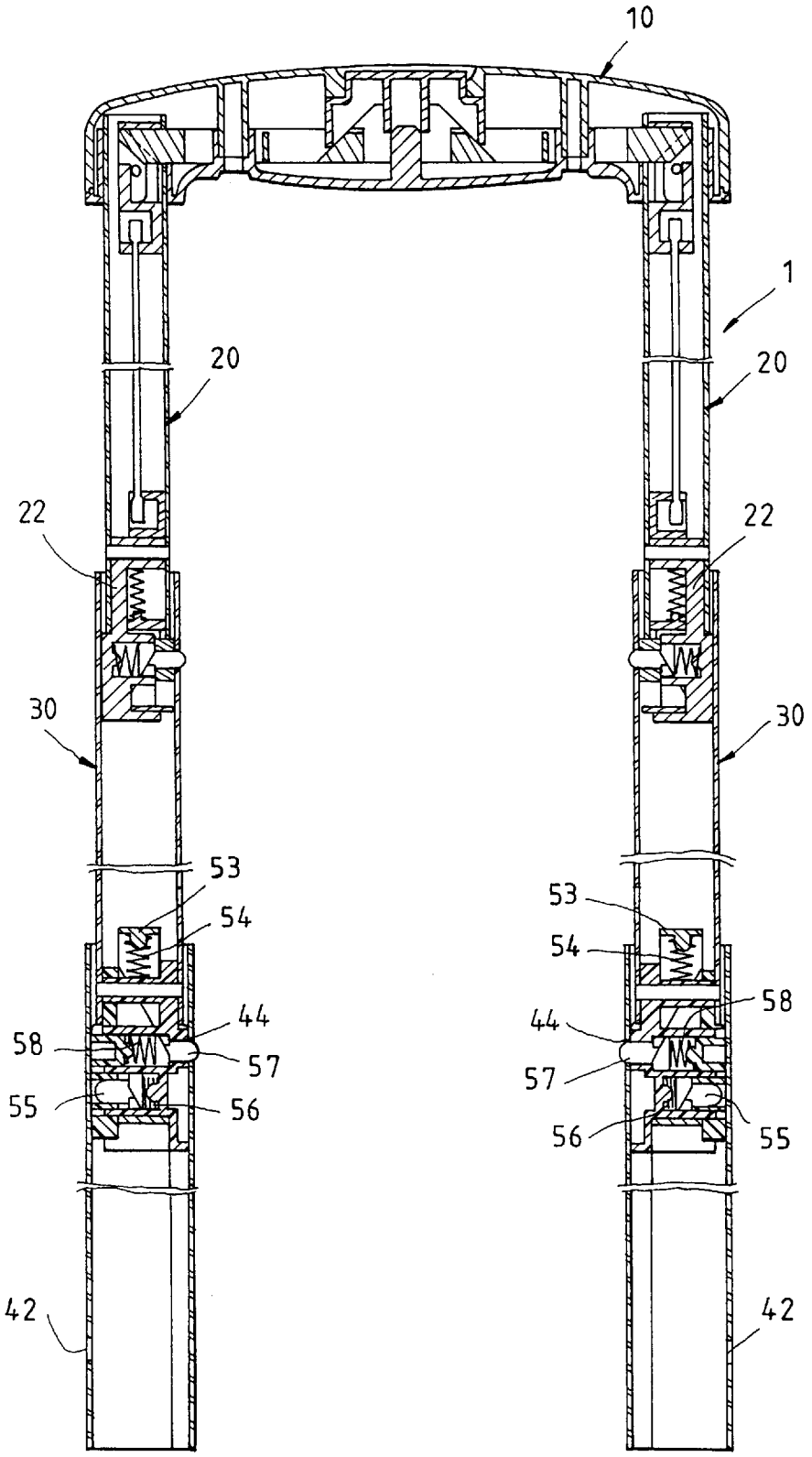
FIG. 4 shows a sectional view of the present invention in the extraction state.

As illustrated in FIG. 3, the three-segmented pull rod 1 of the present invention can be fully extracted by releasing the retaining member 22. Please refer to the U.S. Ser. No. 08/680,548 for details of the process of releasing the retaining member 22. As the retaining member 22 is released, the control member 53 of the locating set 50 is urged by the main elastic element 54 such that the control member 53 is forced to move to the higher level. In the meantime, the first segment 20 and the handle 10 are caused to spring up, whereas the first retaining member 55 is subjected to being pushed by the first inclined surface 531 to retract into the casing 51, thereby resulting in the disengagement of the second segment 30 with the third segment 40. As the bottom end of the second segment 30 is raised by the user to the top end of the third segment 40, the projection 572 of the second retaining member 57 of the locating set 50 is extended to the outside of the casing 51 via the second side hole 515 to engage with the second retaining hole 44 of the third segment 40, as shown in FIG. 4.

On the other hand, the pull rod 1 of the present invention can be retracted by pushing the first segment 20 back into the second segment 30 such that the control member 53 of the locating set 50 is forced to move downwards to reach the low level by the retaining member 22, thereby causing the second inclined surface 532 to push the second retaining member 57, which is thus released. After the second segment 30 is retracted into the third segment 40, the first retaining member 55 is once again engaged with the first retaining hole 42 located at the bottom end of the third segment 40.

What is claimed is:

1. A three-segmented expandable pull rod comprising:

a handle;

two first segments fastened with two ends of said handle;

two second segments for receiving therein said first segments such that said first segments can be extracted from said second segments, and that said first segments can be retracted into said second segments;

two third segments; and two locating sets;

wherein said two third segments are intended to receive therein said two second segments such that said two second segments can be extracted from and retracted into said third segments, said third segments provided respectively at a bottom end thereof with a first retaining hole and at a top end thereof with a second retaining hole;

wherein said two locating sets have a casing which is fastened with a bottom end of said second segment and is provided at a top thereof with a top hole, in a side thereof with a first side hole and a second side hole, said locating sets further having a control member which is disposed in said casing such that said control member is capable of a displacement along the direction of a longitudinal axis of said casing, said control member having at least one first inclined surface and at least one second inclined surface, said locating sets still further having a main elastic element capable of urging said control member such that a top end of said control member is pushed through said top hole, said locating sets still further having a first retaining member which is located in said casing such that said first retaining member is capable of a horizontal displacement to extend through said first side hole, said first retaining member having an inclined portion capable of an intimate contact with said first inclined surface, said locating sets still further having a first elastic element for urging said first retaining member in a direction towards said first side hole, said locating sets still further having a second retaining member which is located in said casing such that said second retaining member is capable of a horizontal displacement to extend through said second side hole, said second retaining member having an inclined portion capable of an intimate contact with said second inclined surface, said locating sets still further having a second elastic element for urging said second retaining member in a direction towards said second side hole;

wherein said first and second segments are retracted into said third segment such that a bottom end of said first segment presses against said control member so as to cause said second inclined surface to force said second retaining member to retract, thereby causing said first retaining member to engage said first retaining hole via said first side hole;

wherein said first and second segments are extracted from said third segment such that said control member is urged by said main elastic element so as to cause said first inclined surface to force said first retaining member to retract, thereby causing said second retaining member to engage said second retaining hole via said second side hole.

2. The pull rod as defined in claim 1, wherein said second retaining hole is located in opposite inner sides of said two third segments; and wherein said first retaining hole is located in outer sides of said two third segments.

3. The pull rod as defined in claim 1, wherein said casing of said locating sets is formed of an inner casing member and an outer casing member.

4. The pull rod as defined in claim 1, wherein said casing of said locating sets is provided therein a predetermined number of fitting pillars and cross partitions; and wherein said control member is of a plate frame construction and is engaged with said pillars and said cross partitions in such a manner that said control member is capable of a limited longitudinal displacement in said casing.

5. The pull rod as defined in claim 4, wherein said main elastic element of said locating sets has one end urging a top of said control member, and other end urging a top of said pillars.

6. The pull rod as defined in claim 4, wherein said first retaining member and said second retaining member are respectively located between two of said cross partitions such that said first retaining member and said second retaining member are capable of a displacement in a predetermined direction.

7. The pull rod as defined in claim 6, wherein said first retaining member and said second retaining member have an end plate and a projection extending from said end plate such that said projection is capable of passing through said side holes.

8. The pull rod as defined in claim 7, wherein said control member has two inner walls provided respectively with said first inclined surface and said second inclined surface; and wherein said inclined portions of said retaining members are located on two sides of said end plates.

* * * * *